US011615911B2

(12) United States Patent
Jung et al.

(10) Patent No.: US 11,615,911 B2
(45) Date of Patent: Mar. 28, 2023

(54) COIL COMPONENT HAVING DUAL INSULATING STRUCTURE

(71) Applicant: SAMSUNG ELECTRO-MECHANICS CO., LTD., Suwon-si (KR)

(72) Inventors: Jung Hyuk Jung, Suwon-si (KR); Sung Hee Kim, Suwon-si (KR); Young Sun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 374 days.

(21) Appl. No.: 16/879,020

(22) Filed: May 20, 2020

(65) Prior Publication Data

US 2021/0233703 A1 Jul. 29, 2021

(30) Foreign Application Priority Data

Jan. 28, 2020 (KR) ..... 10-2020-0009966

(51) Int. Cl.
*H01F 27/29* (2006.01)
*H01F 27/24* (2006.01)

(52) U.S. Cl.
CPC ..... *H01F 27/292* (2013.01); *H01F 27/24* (2013.01)

(58) Field of Classification Search
CPC ..... H01F 27/292; H01F 27/24
See application file for complete search history.

(56) References Cited

U.S. PATENT DOCUMENTS 9,576,711 B2 2/2017 Yoon et al.
2005/0264975 A1 12/2005 Yamazaki
(Continued)

FOREIGN PATENT DOCUMENTS

CN 1702786 A 11/2005
CN 105990008 A 10/2016
(Continued)

OTHER PUBLICATIONS

Office Action issued in corresponding Korean Patent Application No. 10-2020-0009966 dated Nov. 6, 2020, with English translation.
(Continued)

*Primary Examiner* — Rafael O De Leon Domenech
(74) *Attorney, Agent, or Firm* — Morgan, Lewis & Bockius LLP

(57) ABSTRACT

A coil component includes a body, a support substrate embedded in the body, a first coil portion and a second coil portion disposed on the support substrate, a first external electrode and a second external electrode disposed on one end surface of the body to be spaced apart from each other, a third external electrode and a fourth external electrode disposed on the other end surface of the body to be spaced apart from each other, a surface insulating layer disposed on one surface of the body connecting the one end surface and the other end surface of the body to each other, and an edge protection layer disposed between the first and second external electrodes and between the third and fourth external electrodes in the one end surface and the other end surface of the body, and having one end portion extending upwardly of the surface insulating layer.

19 Claims, 5 Drawing Sheets

(56) References Cited

U.S. PATENT DOCUMENTS

| | | | | |
|---|---|---|---|---|
| 2014/0125445 | A1 | 5/2014 | Sim et al. | |
| 2016/0078986 | A1 | 3/2016 | Yoon et al. | |
| 2016/0086714 | A1* | 3/2016 | Moon | H01F 17/0013 336/200 |
| 2017/0372832 | A1 | 12/2017 | Choi et al. | |
| 2018/0211762 | A1 | 7/2018 | Jung et al. | |

FOREIGN PATENT DOCUMENTS

| | | | |
|---|---|---|---|
| JP | 2005-166791 | A | 6/2005 |
| KR | 10-2016-0032580 | A | 3/2016 |
| KR | 10-2017-0097496 | A | 8/2017 |
| KR | 10-2018-0001021 | A | 1/2018 |
| KR | 10-2018-0028374 | A | 3/2018 |
| KR | 10-2018-0086713 | A | 8/2018 |

OTHER PUBLICATIONS

Chinese Office Action dated Oct. 10, 2022, issued in corresponding Chinese Patent Application No. 202010867843.7 (with English translation).

* cited by examiner

COIL COMPONENT HAVING DUAL INSULATING STRUCTURE

CROSS-REFERENCE TO RELATED APPLICATION(S)

The present application claims the benefit of priority to Korean Patent Application No. 10-2020-0009966, filed on Jan. 28, 2020 in the Korean Intellectual Property Office, the entire disclosure of which is incorporated herein by reference.

TECHNICAL FIELD

The present disclosure relates to a coil component.

BACKGROUND

An inductor, a coil component, is a typical passive electronic component used in electronic devices, along with a resistor and a capacitor.

There is increasing demand for an array-type coil component, among coil components, to reduce a mounting area. The array-type coil component may have a noncoupled or coupled inductor type, or a combination type thereof depending on a coupling coefficient between a plurality of coil portions, or mutual inductance.

Many applications require a coupled inductor having a certain degree of leakage inductance while having a coupling coefficient of about 0.1 to about 0.9, rather than a noncoupled inductor, and it is necessary to control the coupling coefficient for each application.

In a coupler inductor, even when an arrangement between coil portions is designed for a target coupling coefficient, leakage current generated in the coupled inductor may cause a designed value of the coupling coefficient to be different from an actual value.

SUMMARY

An aspect of the present disclosure is to provide a coil component which may easily control a coupling coefficient in an array-type coil component.

According to an aspect of the present disclosure, a coil component includes a body, a support substrate embedded in the body, a first coil portion and a second coil portion disposed on the support substrate to be spaced apart from each other, a first external electrode and a second external electrode disposed on a first end surface of the body to be spaced apart from each other, and respectively connected to both end portions of the first coil portion exposed to the first end surface of the body to be spaced apart from each other, a third external electrode and a fourth external electrode disposed on a second end surface of the body to be spaced apart from each other, and respectively connected to both end portions of the second coil portion exposed to the second end surface of the body to be spaced apart from each other, a surface insulating layer disposed on a first surface of the body connecting the first end surface and the second end surface of the body to each other, and an edge protection layer disposed between the first and second external electrodes and between the third and fourth external electrodes on the first end surface and the second end surface of the body, respectively, the edge protection layer having a first end portion extending upwardly of the surface insulating layer.

According to another aspect of the present disclosure, a coil component includes a body, a support substrate embedded in the body, a first coil portion and a second coil portion disposed on the support substrate to be spaced apart from each other, a first external electrode and a second external electrode disposed on a first end surface of the body to be spaced apart from each other, and respectively connected to both end portions of the first coil portion exposed to the first end surface of the body, a third external electrode and a fourth external electrode disposed on a second end surface of the body, opposing the first end surface of the body, to be spaced apart from each other, and respectively connected to both end portions of the second coil portion exposed to the second end surface of the body, a surface insulating layer disposed on a first surface of the body connecting the first end surface and the second end surface of the body to each other, a first edge protection layer disposed between the first and second external electrodes on the first end surface of the body, and a second edge protection layer disposed between the third and fourth external electrodes on the second end surface of the body, wherein one end of each of the first and second edge protection layers further extends onto at least a portion of a surface of the surface insulating layer which opposes another surface of the surface insulating layer contacting the first surface of the body.

BRIEF DESCRIPTION OF DRAWINGS

The above and other aspects, features, and advantages of the present disclosure will be more clearly understood from the following detailed description, taken in conjunction with the accompanying drawings.

DETAILED DESCRIPTION

Figure 1:
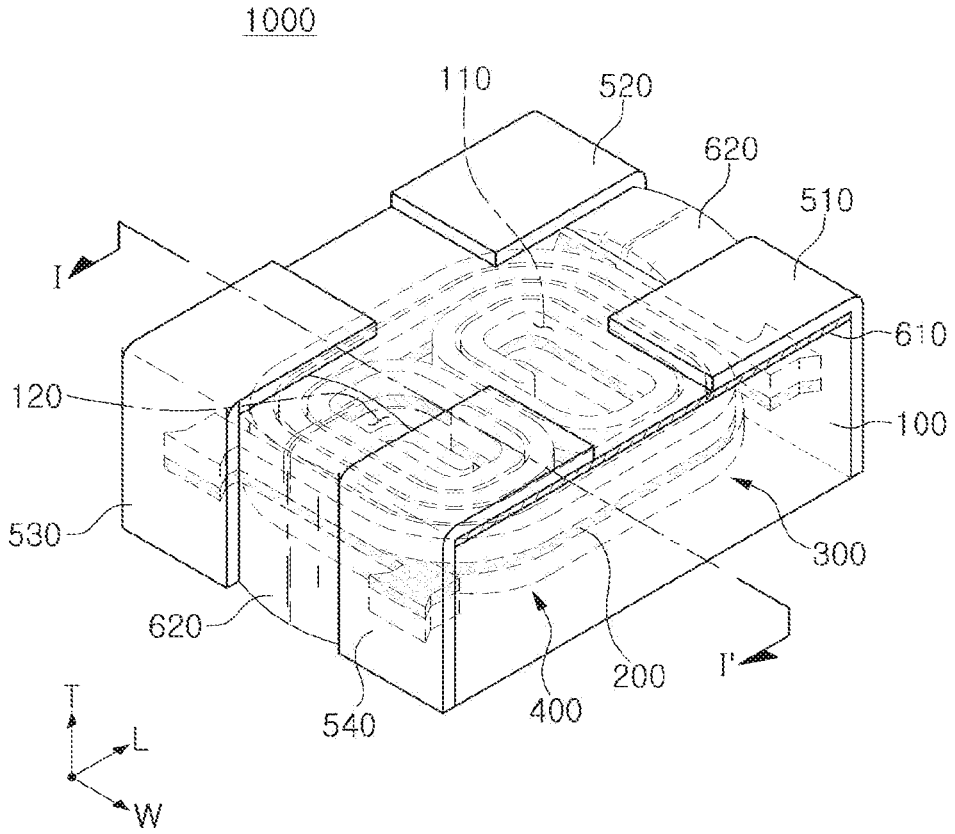
FIG. 1 is a schematic diagram of a coil component according to an exemplary embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an exemplary embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Figure 2:
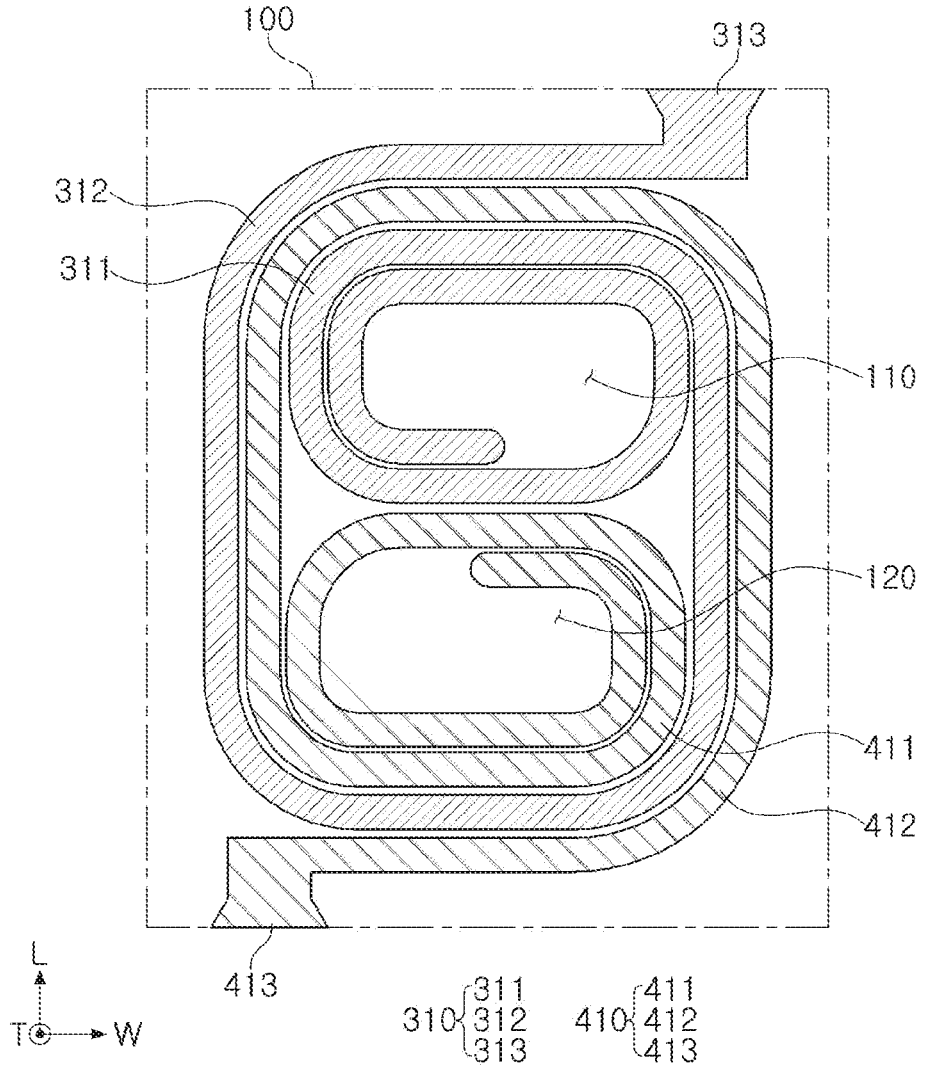
FIG. 2 illustrates an arrangement of a first coil portion and a second coil portion on one surface of a support substrate, and is a plan view of FIG. 1.
Figure 3:
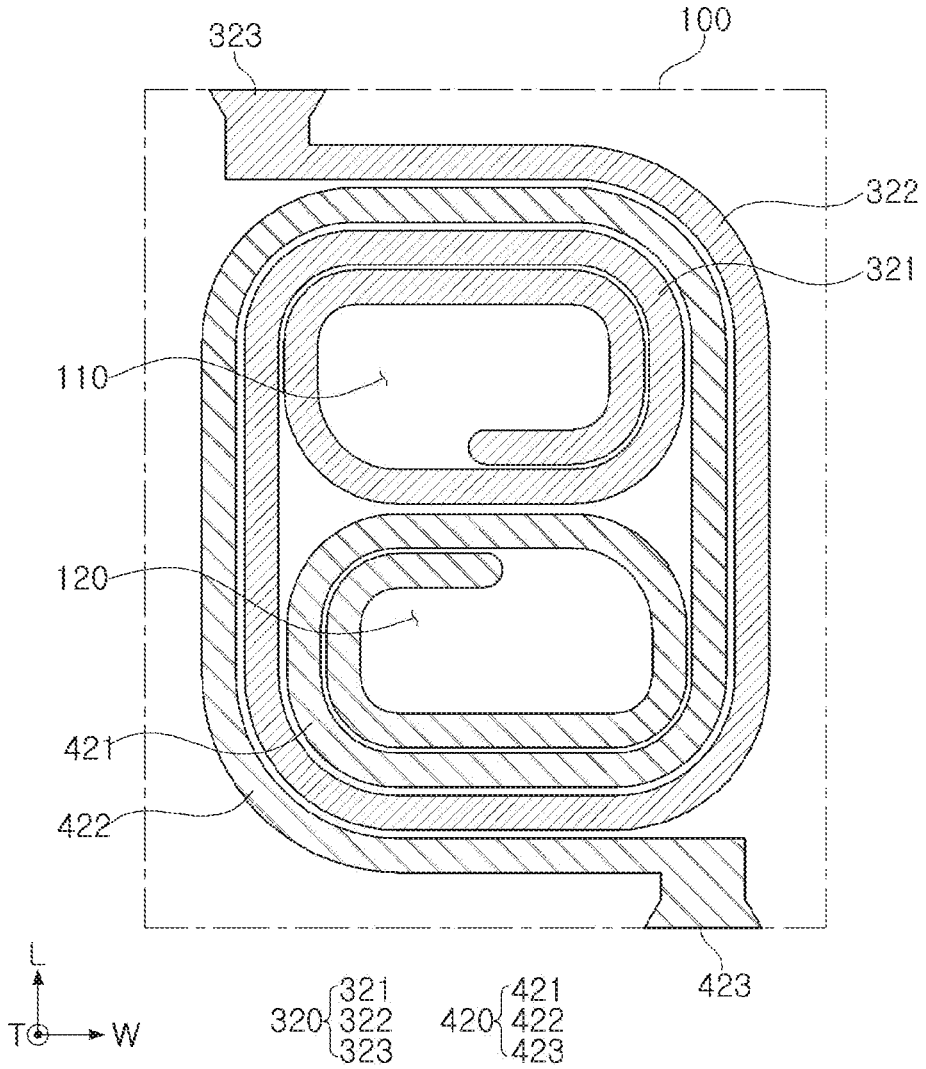
FIG. 3 illustrates an arrangement of a first coil portion and a second coil portion on the other surface of a support substrate, and is a plan view of FIG. 1.
Figure 4:
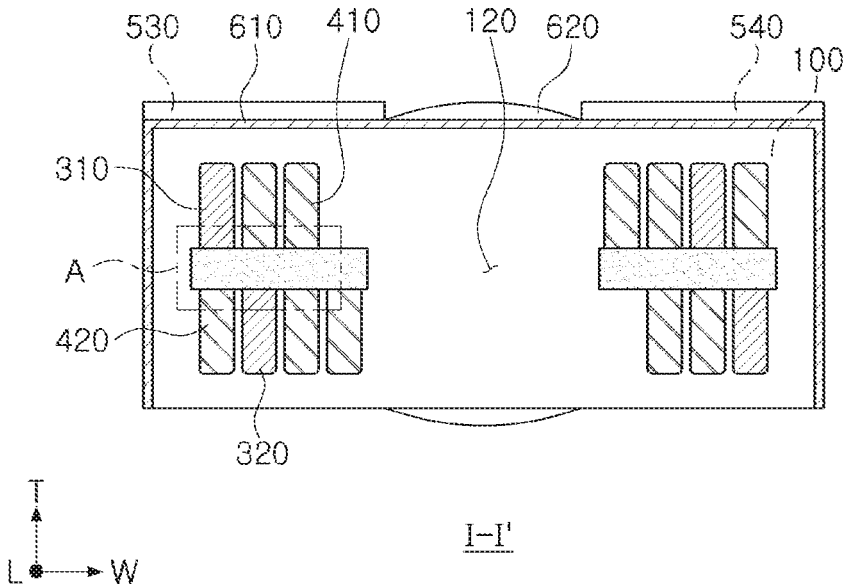
FIG. 4 is a cross-sectional view taken along line I-I' in FIG. 1.
Figure 5:
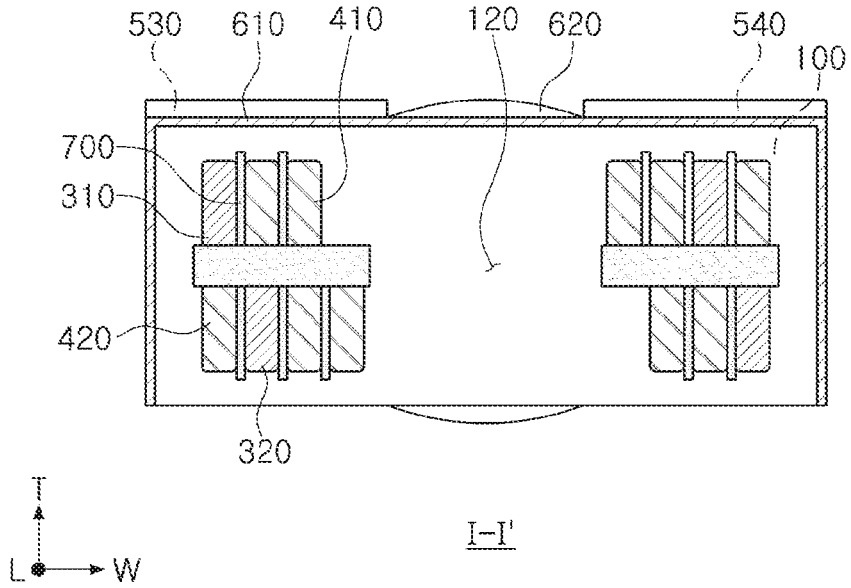
FIG. 5 illustrates a modified example of FIG. 4.
Figure 6:
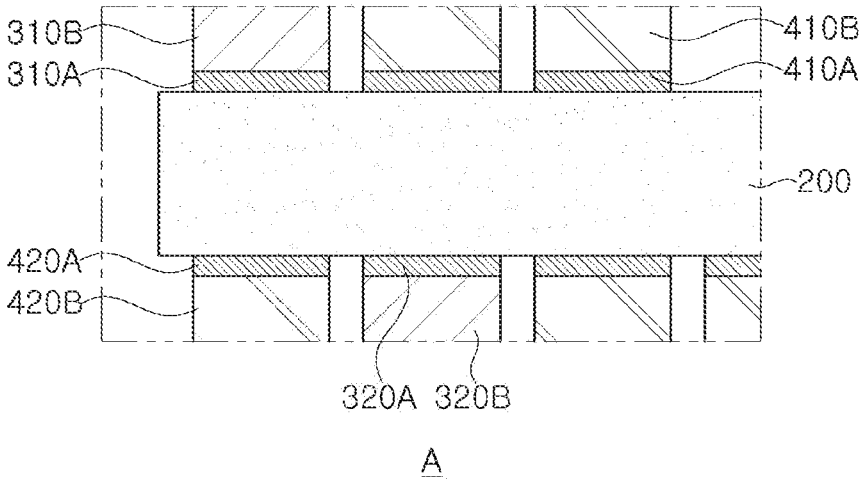
FIG. 6 is an enlarged view of portion 'A' of FIG. 4.
Figure 7:
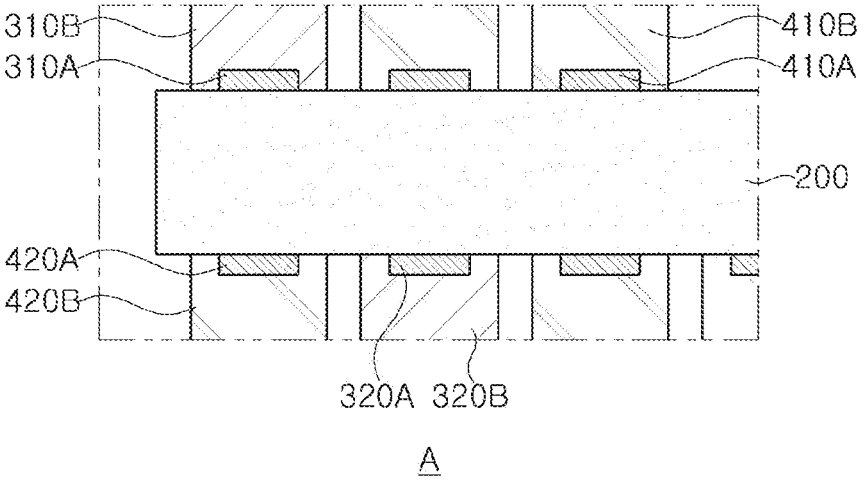
FIG. 7 illustrates a modified example of FIG. 6.

FIG. 1 is a schematic diagram of a coil component according to an exemplary embodiment. FIG. 2 illustrates an arrangement of a first coil portion and a second coil portion on one surface of a support substrate, and is a plan view of FIG. 1. FIG. 3 illustrates an arrangement of a first coil portion and a second coil portion on the other surface of a support substrate, and is a plan view of FIG. 1. FIG. 4 is a cross-sectional view taken along line I-I' in FIG. 1. FIG. 5 illustrates a modified example of FIG. 4. FIG. 6 is an enlarged view of portion 'A' of FIG. 4. FIG. 7 illustrates a modified example of FIG. 6.

Referring to FIGS. 1 to 7, a coil component 1000 according to an exemplary embodiment may include a body 100, a support substrate 200, a first coil portion 300, a second coil portion 400, external electrodes 510, 520, 530, and 540, a surface insulating layer 610, and an edge protection layer 620. In the modified example of this embodiment, the coil component 1000 may further include an insulating material 700.

The body 100 may form an exterior of the coil component 1000, and may embed the support substrate 200, the first coil portion 300, and the second coil portion 400 therein.

The body 100 may be formed to have a hexahedral shape overall.

Based on FIG. 1, the body 100 has a firs surface and a second surface opposing each other in a length direction L, a third surface and a fourth surface opposing each other in a width direction W, and a fifth surface and a sixth surface opposing each other in a thickness direction T. Each of the first to fourth surfaces of the body 100 may correspond to a wall surface of the body 100 connecting the fifth surface and the sixth surface of the body 100. Hereinafter, both end surfaces of the body 100 may refer to the first surface and the second surface of the body 100, respectively, one surface of the body 100 may refer to the fifth surface 106 of the body 100, and the other surface of the body 100 may refer to the sixth surface 105 of the body 100. In addition, hereinafter, an upper surface and a lower surface of the body 100 may refer to the fifth surface 105 and the sixth surface 106 of the body 100 defined based on a direction of FIG. 1, respectively.

The body 100 may include a magnetic material and a resin. Specifically, the body 100 may be formed by laminating one or more magnetic composite sheets including a resin and a magnetic material dispersed in the resin. However, the body 100 may have a structure, other than the structure in which the magnetic material is dispersed in the resin. For example, the body 100 may be formed of a magnetic material such as ferrite.

The magnetic material may be ferrite or magnetic metal powder particles.

Examples of the ferrite powder particles may be at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The magnetic metal powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The magnetic metal powder particle may be amorphous or crystalline. For example, the magnetic metal powder particle may be a Fe—Si—B—Cr-based amorphous alloy powder, but is not limited thereto.

Each of the magnetic metal powder particles may have an average diameter of about 0.1 μm to about 30 μm, but is not limited thereto.

The body 100 may include two or more types of magnetic powder particles dispersed in an insulating resin. In this case, the term "different types of magnetic powder particle" means that the magnetic powder particles, dispersed in the insulating resin, are distinguished from each other by diameter, composition, crystallinity, and shape.

The insulating resin may include an epoxy, a polyimide, a liquid crystal polymer, or the like, in a single form or in combined forms, but is not limited thereto.

The body 100 may include a first core 110, penetrating through the support substrate 200 and the first coil portion 300, and a second core 120 penetrating through the support substrate 200 and the second coil portion 400. The first and second cores 110 and 120 may be formed by filling through-holes of the support substrate 200 with at least a portion of the magnetic composite sheet in processes of laminating and curing the magnetic composite sheet, but a method of forming the core 110 is not limited thereto.

The support substrate 200 may be embedded in the body 100. The support substrate 200 may support the coil portions 300 and 400 to be described later.

The support substrate 200 may include an insulating material, for example, a thermosetting insulating resin such as an epoxy resin, a thermoplastic insulating resin such as polyimide, or a photosensitive insulating resin, or the support substrate 200 may include an insulating material in which a reinforcing material such as a glass fiber or an inorganic filler is impregnated with an insulating resin. For example, the support substrate 200 may include an insulating material such as prepreg, Ajinomoto Build-up Film (ABF), FR-4, a bismaleimide triazine (BT) film, a photo-imageable dielectric (PID) film, and the like, but are not limited thereto.

The inorganic filler may be at least one or more selected from the group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

When the support substrate 200 is formed of an insulating material including a reinforcing material, the support substrate 200 may provide better rigidity. When the support substrate 200 is formed of an insulating material not containing glass fibers, the support substrate 200 may be advantageous in thinning the overall component. When the support substrate 200 is formed of an insulating material containing a photosensitive insulating resin, the number of processes of forming the coil portion 300 and 400 may be reduced. Therefore, it may be advantageous in reducing production costs and advantageous in forming a fine via.

The first and second coil portions 300 and 400 are spaced apart from each other on the support substrate 200 to exhibit characteristics of the coil component 1000. For example, the coil component 1000 may be a coupled inductor having a coupling coefficient k between the first and second coil portions 300 and 400, which is greater than 0 to 1 or less, but is not limited thereto.

The first coil portion 300 has first winding portions 311 and 321 forming at least one turn about the first core 110, extension portions 312 and 322 extending form end portions of the first winding portions 311 and 321 to surround the first and second cores 110 and 120, and first lead-out portions 313 and 323 extending from the first extension portions 312 and 322 to be spaced apart from each other and to be exposed to one end surface of the body 100. The second coil portion 400 has second winding portions 411 and 421 forming at least one turn about the second core 120, second extension portions 412 and 422 extending from end portions of the second winding portions 411 and 421 to surround the first and second cores 110 and 120, and second lead-out portions 413 and 423 extending from the second extension portions 412 and 422 to be spaced apart from each other and to be exposed to the other end surface of the body 100.

Specifically, referring to FIGS. 1 to 3, based on a direction of FIG. 1, the first coil portion 300 includes a first upper coil pattern 310 disposed on an upper surface of the support substrate 200, a first lower coil pattern 320 disposed on a lower surface of the support substrate 200, and a first via connecting the first upper coil pattern 310 and the first lower coil pattern 320 to each other through the support substrate 200. The first upper coil pattern 310 has a first upper winding portion 311 forming at least one turn about the first core 110, a first upper extension portion 312 extending from one end portion of the first upper winding portion 311 to surround the first and second cores 110 and 120 and having an end portion disposed to be closer to one end surface of the body 100 than an outermost turn of the first upper winding portion 311, and a first upper lead-out portion 313 extending from the first upper extension portion 312 to be exposed to one end surface of the body 100. The first lower coil pattern 320 has a first lower winding portion 321 forming at least one turn about the first core 110, a first lower extension portion 322 extending from one end portion of the first lower winding portion 321 to surround the first and second cores 110 and 120 and having an end portion disposed to be closer to one end surface of the body 100 than an outermost turn of the first lower winding portion 321, and a first lower lead-out portion 323 extending from the first lower extension portion 322 to be exposed to one end surface of the body 100. The other end portion of the first upper winding portion 311 and the other end portion of the first lower winding portion 321 are each in contact with and connected to the first via, and the first upper lead-out portion 313 and the first lower lead-out portion 323 are spaced apart from each other to be exposed to one end surface of the body 100. First and second external electrodes 510 and 520 to be described later are disposed on one end surface of the body 100 to be spaced apart from each other and are respectively connected to the first upper lead-out portion 313 and the first lower lead-out portion 323. Accordingly, the first coil portion 300 may serve as a single coil in a form extending from the first upper lead-out portion 313 to the first lower lead-out portion 323.

Specifically, referring to FIGS. 1 to 3, based on the direction of FIG. 1, the second coil portion 400 includes a second upper coil pattern 410 disposed on an upper surface of the support substrate 200, a second lower coil pattern 420 disposed on a lower surface of the support substrate 200, and a second via connecting the second upper coil pattern 410 and the second lower coil pattern 320 to each other through the support substrate 200. The second upper coil pattern 410 has a second upper winding portion 411 forming at least one turn about the second core 110, a second upper extension portion 412 extending from one end portion of the second upper winding portion 411 to surround the second and second cores 110 and 120 and having an end portion disposed to be closer to one end surface of the body 110 than an outermost turn of the second upper winding portion 411, and a second upper lead-out portion 413 extending from the second upper extension portion 412 to be exposed to one end surface of the body 100. The second lower coil pattern 420 has a second lower winding portion 421 forming at least one turnabout the second core 110, a second lower extension portion 422 extending from one end portion of the second lower winding portion 421 to surround the second and second cores 110 and 120 and having an end portion disposed to be closer to the other end surface of the body 100 than an outermost turn of the second lower winding portion 421, and a second lower lead-out portion 423 extending from the second lower extension portion 322 to be exposed to the other end surface of the body 100. The other end portion of the second upper winding portion 411 and the other end portion of the second lower winding portion 421 are each in contact with and connected to the second via, and the second upper lead-out portion 313 and the second lower lead-out portion 423 are spaced apart from each other to be exposed to the other end surface of the body 100. Third and fourth external electrodes 530 and 540, to be described later, are disposed on one end surface of the body 100 to be spaced apart from each other and are respectively connected to the second upper lead-out portion 413 and the second lower lead-out portion 423. Accordingly, the second coil portion 400 may serve as a single coil in a form extending from the second upper lead-out portion 413 to the second lower lead-out portion 423.

Referring to FIGS. 1 to 3, based on a center of the length direction L of the body 100, the second extension portions 412 and 422 of the second coil portion 400 are disposed between outermost turns of the first winding portions 311 and 321 and the first extension portions 312 and 322 on a side of the one end surface of the body 100. Similarly, the first extension portions 312 and 322 of the first coil portion 300 are disposed between outermost turns of the second winding portions 411 and 421 and the second extension portions 412 and 422 on a side of the other end surface of the body 100. For example, the first and second coil portions 300 and 400 may be disposed to have a structure in which turns are alternately disposed, and thus, electromagnetic coupling between the first and second coil portions 300 and 400 may be easily performed.

Referring to FIG. 6, each of the first and second coil portions 300 and 400 may include a first conductive layer, disposed to be in contact with the support substrate 200, and a second conductive layer disposed on the first conductive layer and exposing a side surface of the first conductive layer. Specifically, based on a direction of FIG. 6, the first upper coil pattern 310 and the first lower coil pattern 320 of the first coil portion 300 include first conductive layers 310A and 320A, formed to be in contact with an upper surface and a lower surface of the support substrate 200, and second conductive layers 310B and 320B disposed on the first conductive layers 310A and 320A and exposing side surfaces of the first conductive layers 310A and 320A, respectively. The second upper coil pattern 410 and the second lower coil pattern 420 of the second coil portion 400 include first conductive layers 410A and 420A, formed to be in contact with the upper surface and the lower surface of the support substrate 200, and second conductive layers 410B and 420B disposed on the first conductive layers 410A and 420A and exposing side surfaces of the first conductive layers 410A and 420A, respectively. The first conductive layers 310A, 320A, 410A, and 420A may be seed layers for plating and forming the second conductive layers 310B, 320B, 410B, and 420B on the support substrate 200. In FIG. 6, the first and second coil portions 300 and 400 may be formed by respectively forming seed layers for forming a first conductive layer on entire surfaces of both surfaces of the support substrate 200, respectively forming plating resists for forming first and second coil portions on the seed layers, forming second conductive layers 310B, 320B, 410B, and 420B in openings of the plating resists for forming the first and second coil portions by plating, removing the plating resists for forming the first and second coil portions, and the seed layers exposed to an external entity. As a result of the above process, the second conductive layers 310B, 320B, 410B, and 420B may be formed in such a manner that they do not cover side surfaces of the first conductive layers 310A, 320A, 410A, and 420A.

Referring to FIG. 7, each of the first and second coil portions 300 and 400 may include a first conductive layer, disposed to be in contact with the support substrate 200, and a second conductive layer covering a side surface of the first conductive layer to be in contact with the support substrate 200. Specifically, referring to FIG. 7, based on a direction of FIG. 7, the first upper coil pattern 310 and the first lower coil pattern 320 of the first coil portion 300 include first conductive layers 310A and 320A, formed to be in contact with an upper surface and a lower surface of the support substrate 200, and second conductive layers 310B and 320B disposed on the first conductive layers 310A and 320A and covering side surfaces of the first conductive layers 310A and 320A to be in contact with the support substrate 200, respectively. The second upper coil pattern 410 and the second lower coil pattern 420 of the second coil portion 400 includes first conductive layers 410A and 420A, formed to be in contact with the upper surface and the lower surface of the support substrate 200, and second conductive layers 410B and 420B disposed on the first conductive layers 410A and 420A and covering side surfaces of the first conductive layers 410A and 420A to be in contact with the support substrate 200, respectively. The first conductive layers 310A, 320A, 410A, and 420A may be seed layers for plating and forming the second conductive layers 310B, 320B, 410B, and 420B on the support substrate 200. In FIG. 7, the first and second coil portions 300 and 400 may be formed by respectively forming first conductive layers 310A, 320A, 410A, and 420A corresponding to shapes of the coil patterns 310, 320, 410, and 420 on both surfaces of the support substrate 200, forming plating resists in separation spaces between turns of the first conductive layers 310A, 320A, 410A, and 420A, forming second conductive layers 310B, 320B, 410B, and 420B in openings of the plating resists by plating, and removing the plating resists. In the above-described example, a description has been given under the assumption that plating resists are used when the second conductive layer 310B, 320B, 410B, and 420B are formed. However, in the case of an anisotropic plating method, the second conductive layer 310B, 320B, 410B, and 420B may be formed without using a plating resist.

Since the first conductive layer 310A, 320A, 410A, and 420A are seed layers for forming the second conductive layer 310B, 320B, 410B, and 420B by electroplating, the first conductive layer 310A, 320A, 410A and 420A are formed to have relatively smaller thickness than the second conductive layers 310B, 320B, 410B, and 420B. The first conductive layers 310A, 320A, 410A, and 420A may be formed by a thin-film process, such as sputtering, or an electroless plating process. When the first conductive layers 310A, 320A, 410A, 420A are formed by a thin-film process such as sputtering, at least a portion of materials constituting the first conductive layers 310A, 320A, 410A, and 420A may penetrate through the surface of the support substrate 200. This may be confirmed by the fact that a difference in concentration of metal materials, constituting the first conductive layers 310A, 320A, 410A, and 420A, in the support substrate occurs in a thickness direction T of the body 100.

Each of the first conductive layers 310A, 320A, 410A, and 420A may have a thickness of 1.5 μm or more to 3 μm or less. When each of the first conductive layers 310A, 320A, 410A, and 420A has a thickness less than 1.5 μm, it may be difficult to implement the first conductive layers 310A, 320A, 410A, and 420A, and poor plating may occur in a subsequent process. When each of the first conductive layers 310A, 320A, 410A, and 420A has a thickness greater than 3 μm, it may be difficult for each of the second conductive layers 310B, 320B, 410B, and 420B to have a relatively large volume within a limited volume of the body 100.

The via may include at least one conductive layer. For example, when the via is formed by electroplating, the via may include a seed layer, formed on an internal wall of a via hole penetrating through the support substrate 200, and an electroplating layer filling the via hole in which the seed layer is formed. The seed layer of via and the first conductive layers 310A, 320A, 410A, 420A may be formed in the same process to be integrated with each other, or may be formed in different processes to form boundaries therebetween. An electroplating layer of the via and the second conductive layers 310B, 320B, 410B, and 420B may be formed in the same process to be integrated with each other, or may be formed in different processes to form boundaries therebetween.

When each of the coil patterns 310, 320, 410, and 420 has a significantly large linewidth, a volume of a magnetic material in the same body 100 may be reduced to have an adverse effect on inductance. As a non-limiting example, a ratio of a thickness to a width of each turn of the coil patterns 310, 320, 410, and 420, based on a cross section in a width-thickness (W-T) direction, for example, an aspect ratio (AR) may be 3:1 to 9:1.

Each of the coil patterns 310, 320, 410, 420 and the via may be formed of a conductive layer such as copper (Cu), aluminum (Al), silver (Ag), tin (Sn), gold (Au), nickel (Ni), lead (Pb), titanium (Ti), chromium (Cr), or alloys thereof, but a material thereof is not limited thereto. As one non-limiting example, when the first conductive layers 310A, 320A, 410A, and 420A are formed by sputtering and the second conductive layers 310B, 320B, 410B, and 420B are formed by electroplating, the first conductive layers 310A, 320A, 410A, and 420A include at least one of molybdenum (Mo), chromium (Cr), copper (Cu), and titanium (Ti), and the second conductive layers 310B, 320B, 410B, and 420B may include copper (Cu). As another non-limiting example, when the first conductive layer 310A, 320A, 410A, and 420A are formed by electroless plating and the second conductive layers 310B, 320B, 410B, and 420B are formed by electroplating, each of the first conductive layers 310A, 320A, 410A, and 420A and the second conductive layers 310B, 320B, 410B, and 420B may include copper (Cu). In this case, density of copper (Cu) in the first conductive layers 310A, 320A, 410A, and 420A may be lower than density of copper (Cu) in the second conductive layers 310B, 320B, 410B, and 420B.

The first and second external electrodes 510 and 520 are disposed on one end surface of the body 100 to be spaced apart from each other, and are respectively connected to both end portions of the first coil portion 300 exposed to the one end surface of the body 100 to be spaced apart from each other. The third and fourth external electrodes 530 and 540 are disposed on the other end surface of the body 100 to be spaced apart from each other, and are respectively connected to both end portions of the second coil portion 400 exposed to the other end surface of the body 100 to be spaced apart from each other. Specifically, the first upper lead-out portion 313 and the first lower lead-out portion 323 of the first coil portion 300, exposed to the one end surface of the body 100 to be spaced apart from each other, are in contact with and connected to the first and second external electrodes 510 and 520. The second upper lead-out portion 413 and the second lower lead-out portion 423 of the second coil portion 400, exposed to the other end surface of the body 100 to be spaced apart from each other, are in contact with and connected to the third and fourth external electrodes 530 and 540.

Each of the external electrodes 510, 520, 530, and 540 may be formed of a conductive layer such as copper (Cu), aluminum (Al), silver (Ag), tin (Sn), gold (Au), nickel (Ni), lead (Pb), titanium (Ti), or alloys thereof, but a material thereof is not limited thereto.

The external electrodes 510, 520, 530, and 540 may be formed to have a single-layer structure or a multilayer structure. As an example, the first external electrode 510 includes a first layer including copper, a second layer including nickel disposed on the first layer and including nickel (Ni), and a third layer disposed on the second layer and including tin (Sn). Each of the first to third layers may be formed by plating, but a forming method thereof is not limited thereto. As another example, the first external electrode 510 may include a resin electrode layer, including conductive powder particles and a resin, and a plating layer plated on the resin electrode layer. In this case, the resin electrode layer may include at least one conductive powder particle of copper (Cu) and silver (Ag) and a cured material of a thermosetting resin. In addition, the plating layer may include a first plating layer, including nickel (Ni), and a second plating layer including tin (Sn). When the resin included in the resin electrode layer includes the same resin as the insulating resin of the body 100, the bonding force between the resin electrode layer and the body 100 may be improved. The above description of the first external electrode 510 may be equivalently applied to the second to fourth external electrodes 520, 530, and 540.

Each of the external electrodes 510, 520, 530, and 540 may extend upwardly of one surface of the body 100. Specifically, each of the external electrodes 510, 520, 530, and 540 includes a connection portion, disposed on one end surface and the other end surface of the body 100 to be connected to the lead-out portions 313, 323, 413, and 423, and a pad portion extending upwardly of the one surface of the body 100 from the connection portion. The pad portions of the external electrodes 510, 520, 530, and 540 are disposed on one surface of the body 100, and are disposed to be spaced apart from each other. The coil component 1000 according to this embodiment may be mounted on a mounting substrate through a coupling member such as a solder after one surface of the body 100 is disposed to face a mounting substrate such as a printed circuit board (PCB). Since the external electrodes 510, 520, 530, and 540 are all disposed to extend upwardly of the one surface of the body 100, a volume of the coupling member may be reduced when the coil component 1000 is mounted. Thus, the coil component 1000 may reduce a mounting area occupying the mounting substrate. Since a surface insulating layer 610 to be described later is disposed on one surface of the body 100, the pad portion of each of the external electrodes 510, 520, 530, and 540 is disposed on the surface insulating layer 610, and thus, may not be in contact with the one surface of the body 100, but is not limited thereto. In other words, each of the first to fourth external electrodes 510, 520, 530, and 540 may extend upwardly of at least a portion of one surface of the surface insulating layer 610 which opposes another surface thereof contacting the one surface of the body 100.

The surface insulating layer 610 is disposed on one surface of the body 100. Since the surface insulating layer 610 is interposed between the external electrodes 510, 520, 530, and 540 (in detail, the pad portion) and one surface of the body 100, insulating characteristics between the external electrodes 510, 520, 530, and 540 and the one surface of the body 100 may be improved. For example, leakage current of the entire component may be reduced. As a result, a difference between a design value of a coupling coefficient and an actually measured value may be reduced.

The surface insulating layer 610 may be formed of an insulating material, for example, a thermosetting insulating resin such as an epoxy resin, a thermoplastic insulating resin such as polyimide, or a photosensitive insulating resin, or the surface insulating layer 610 may be formed of an insulating material in which a reinforcing material such as a glass fiber or an inorganic filler is impregnated with an insulating resin. For example, the support substrate 200 may be formed of an insulating material such as prepreg, Ajinomoto Build-up Film (ABF), FR-4, a bismaleimide triazine (BT) film, a photoimageable dielectric (PID) film, or the like. Alternatively, the surface insulating layer 610 may be formed by applying a liquid or paste insulating material to one surface of the body 100 and curing the applied insulating material. When the surface insulating layer 610 includes the same resin as the body 100, bonding force between the surface insulating layer 610 and the body 100 may be improved. The surface insulating layer 610 may also be formed to extend upwardly of the one surface and the other surface of the body 100, but is not limited thereto. Although not illustrated in the drawing, the surface insulating layer 610 may also be formed on the other surface of the body 100. In one exemplary embodiment, the surface insulating layer 610 may further extend onto the one end surface and the other end surface of the body 100.

The edge protection layer 620 is disposed between the first and second external electrodes 510 and 520 in one end surface of the body 100, and has one end portion extending upwardly of the surface insulating layer 610. In addition, the edge protection layer 620 is disposed between the third and fourth external electrodes 530 and 540 in the other end surface of the body 100, and has one end portion extending upwardly of the surface insulating layer 610. Specifically, the edge protection layer 620 covers a region, exposed to an external entity, in a region formed by each of the one end surface and the other end surface of the body 100 and one surface of the body 100.

There is high possibility that cracking occurs in an edge region of a body because stress is concentrated on the edge region due to a shape of the edge region. When cracking occurs in the edge region of the body, leakage current may easily flows along the cracking. Thus, leakage current of the entire component may be increased. An issue, caused by leakage current, may be severe in a region adjacent to an external electrode, in the edge region of the body.

To address the above-mentioned issue, in this embodiment, the edge protection layer 620 is formed to cover a region adjacent to the external electrodes 510, 520, 530, and 540 in the region formed by each of the one end surface and the other end surface of the body 100 and one surface of the body 100. In addition, since the edge protection layer 620 is disposed between the external electrodes 510, 520, 530, and 540 on each of the one end surface and the other end surface of the body 100, insulation resistance may be increased to readily prevent electrical short-circuit between adjacent external electrodes 510, 520, 530, and 540.

The other end portion of the edge protection layer 620 may extend up to an edge formed by each of the one end surface and the other end surface of the body 100 and the other surface of the body 100. For example, the edge protection layer 620 may be formed on each of the one end surface and the other end surface of the body 100, allowing both end portions thereof to extend upwardly of the one surface and the other surface of the body 100. In other words, the edge protection layer 620 may extend onto at least a part of the one surface and at least a part of the other surface of the body 100. The edge protection layer 620, extending upwardly of one surface and the other surface of the body 100, may be formed by printing an insulating paste for forming the edge protection layer 620 on the one end surface and the other end surface of the body 100 in a line printing (for example, TWA printing) manner and curing the insulating paste, but a forming method thereof is not limited thereto.

Each of both end portions of the edge protection layer 620 may have an upwardly convex cross section. For example, the edge protection layer 620 may have a shape in which a thickness is decreased in a direction from a central portion toward an external side disposed to be in contact with the external electrodes 510, 520, 530, and 540. Accordingly, at least a portion of a bonding member such as a solder may be accommodated outside of the edge protection layer 620 during mounting to easily prevent an issue at amounting level, caused by an excessive solder. The edge protection layers 620 may not extend upwardly of each of the external electrodes 510, 520, 530, and 540, as illustrated in FIGS. 4 and 5. When the edge protection layer 620 extends upwardly of each of the external electrodes 510, 520, 530, and 540, a length, a width, and a thickness of the entire component may be increased, and an area, in which a tin-containing (Sn-containing) finishing layer of the external electrode 510, 520, 530, and 540 is formed, may be reduced to deteriorate connection reliability between the bonding member such as a solder and the external electrodes 510, 520, 530, and 540.

The edge protection layer 620 may include an insulating resin and an insulating filler. The insulating resin may include a thermosetting resin in which an epoxy, a polyimide, a liquid crystal polymer, or the like, is in a single form or in combined forms. The insulating filler may be at least one or more selected from the group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$). The inorganic filler include at least one of, for example, acrylonitrile-butadiene-styrene (ABS), cellulose acetate, nylon, polymethyl methacrylate (PMMA), polybenzimidazole, polycarbonate, polyether sulfone, Polyetherether ketone (PEEK), polyetherimide (PEI), polyethylene, polylactic acid, polyoxymethylene, polyphenylene oxide, polyphenylene sulfide, polypropylene, polystyrene, polyvinyl chloride, ethylene vinyl acetate, polyvinyl alcohol, polyethylene oxide, epoxy, and polyimide. In this embodiment, magnetic characteristics of the insulating filler are not problematic when the insulating filler is formed of an electrically insulating material. In this embodiment, the insulating filler may include, for example, an electrically insulating material among the above-mentioned magnetic materials.

Referring to FIG. 5, in the case of a modified example according to this embodiment, an insulating material 600 may be further provided between adjacent turns of the coil patterns 310, 320, 410, and 420. The insulating material 700 may be a permanent resist, remaining in an end product, in which the above-described plating resist for forming the second conductive layer is not removed. However, the scope of the present disclosure is not limited thereto, and the insulating material 700 may be formed by laminating an insulating film on the support substrate 200 to cover the first and second coil portions 300 and 400 after removing the plating resist. The insulating material 700 may prevent electrical short of each of the first and second coil portions 300 and 400 to reduce leakage current. Unlike what is illustrated in the drawing, the insulating material 700 may be formed to have a conformal shape corresponding to a shape of each turn of the first and second coil portions 300 and 400 formed on the support substrate 200. In this case, the insulating material 700 may be an insulating material formed by vapor deposition, or the like, such as perylene, but is not limited thereto.

As described above, in an array-type coil component, a coupling coefficient may be easily controlled.

While example embodiments have been shown and described above, it will be apparent to those skilled in the art that modifications and variations could be made without departing from the scope of the present disclosure as defined by the appended claims.

What is claimed is:

1. A coil component comprising:

a body;

a support substrate embedded in the body;

a first coil portion and a second coil portion disposed on the support substrate to be spaced apart from each other;

a first external electrode and a second external electrode disposed on a first end surface of the body to be spaced apart from each other, and respectively connected to both end portions of the first coil portion exposed to the first end surface of the body to be spaced apart from each other;

a third external electrode and a fourth external electrode disposed on a second end surface of the body to be spaced apart from each other, and respectively connected to both end portions of the second coil portion exposed to the second end surface of the body to be spaced apart from each other;

a surface insulating layer disposed on a first surface of the body connecting the first end surface and the second end surface of the body to each other; and an edge protection layer disposed between the first and second external electrodes and between the third and fourth external electrodes on the first end surface and the second end surface of the body, respectively, the edge protection layer having a first end portion extending upwardly of the surface insulating layer.

2. The coil component of claim 1, wherein the edge protection layer has a second end portion extending to respective edges between a second surface of the body, opposing the first surface of the body, and the first end surface and between the second surface and the second end surface of the body.

3. The coil component of claim 1, wherein the edge protection layer has a second end portion extending onto at least a part of a second surface of the body, opposing the first surface of the body.

4. The coil component of claim 1, wherein the first end portion of the edge protection layer has an upwardly convex cross section.

5. The coil component of claim 1, wherein the edge protection layer includes an insulating resin and an insulating filler.

6. The coil component of claim 1, wherein the edge protection layer does not extend upwardly of each of the first to fourth external electrodes.

7. The coil component of claim 1, wherein each of the first to fourth external electrodes extends upwardly of the first surface of the body.

8. The coil component of claim 7, wherein each of the first to fourth external electrodes extends upwardly of at least a portion of a surface of the surface insulating layer which opposes another surface of the surface insulating layer contacting the first surface of the body.

9. The coil component of claim 1, wherein the body includes a first core and a second core, respectively penetrating through the first coil portion and the second coil portion, the first and second cores being spaced apart from each other, the first coil portion has a first winding portion, including at least one turn about the first core, and a first extension portion extending from one end portion of the first winding portion to surround the first core and the second core, and the second coil portion has a second winding portion, including at least one turn about the second core, and a second extension portion extending from one end portion of the second winding portion to surround the first core and the second core.

10. The coil component of claim 9, wherein the first coil portion includes a first upper coil pattern disposed on a first surface of the support substrate, a first lower coil pattern disposed on a second surface of the support substrate, opposing the first surface of the support substrate, and a first via connecting the first upper coil pattern and the first lower coil pattern to each other through the support substrate, the second coil portion includes a second upper coil pattern disposed on the first surface of the support substrate to be spaced apart from the first upper coil pattern, a second lower coil pattern disposed on the second surface of the support substrate to be spaced apart from the first lower coil pattern, and a second via connecting the second upper coil pattern and the second lower coil pattern to each other through the support substrate, the first winding portion and the first extension portion are disposed in each of the first upper coil pattern and the first lower coil pattern, and the second winding portion and the second extension portion are disposed in each of the second upper coil pattern and the second lower coil pattern.

11. The coil pattern of claim 1, wherein each of the first and second coil portions includes a first conductive layer, disposed to be in contact with the support substrate, and a second conductive layer disposed on the first conductive layer, and a side surface of the first conductive layer is exposed to the body.

12. The coil pattern of claim 1, wherein each of the first and second coil portions includes a first conductive layer, disposed to be in contact with the support substrate, and a second conductive layer disposed on the first conductive layer and covering a side surface of the first conductive layer to be in contact with the support substrate.

13. The coil component of claim 1, further comprising:

an insulating material disposed between the first coil portion and the second coil portion, between adjacent turns of the first coil portion, and between adjacent turns of the second coil portion.

14. The coil component of claim 1, wherein the surface insulating layer further extends onto the first and second end surfaces of the body.

15. A coil component comprising:

a body including;

a support substrate embedded in the body;

a first coil portion and a second coil portion disposed on the support substrate to be spaced apart from each other;

a first external electrode and a second external electrode disposed on a first end surface of the body to be spaced apart from each other, and respectively connected to both end portions of the first coil portion exposed to the first end surface of the body;

a third external electrode and a fourth external electrode disposed on a second end surface of the body, opposing the first end surface of the body, to be spaced apart from each other, and respectively connected to both end portions of the second coil portion exposed to the second end surface of the body;

a surface insulating layer disposed on a first surface of the body connecting the first end surface and the second end surface of the body to each other;

a first edge protection layer disposed between the first and second external electrodes on the first end surface of the body; and a second edge protection layer disposed between the third and fourth external electrodes on the second end surface of the body, wherein one end of each of the first and second edge protection layers further extends onto at least a portion of a surface of the surface insulating layer which opposes another surface of the surface insulating layer contacting the first surface of the body.

16. The coil pattern of claim 15, wherein another end of the first edge protection layer extends to an edge between a second surface of the body, opposing the first surface of the body, and the first end surface, and another end of the second edge protection layer extends to an edge between the second surface and the second end surface of the body.

17. The coil pattern of claim 15, wherein another end of the first edge protection layer extends onto at least a part of a second surface of the body, opposing the first surface of the body, and another end of the second edge protection layer extends onto the second surface of the body.

18. The coil pattern of claim 15, wherein the body includes a first core and a second core, respectively penetrating through the first coil portion and the second coil portion, the first and second cores being spaced apart from each other, the first coil portion has a first winding portion, including at least one turn about the first core, and a first extension portion extending from one end portion of the first winding portion to surround the first core and the second core, and the second coil portion has a second winding portion, including at least one turn about the second core, and a second extension portion extending from one end portion of the second winding portion to surround the first core and the second core.

19. The coil component of claim 18, wherein the first coil portion includes a first upper coil pattern disposed on a first surface of the support substrate, a first lower coil pattern disposed on a second surface of the support substrate, opposing the first surface of the support substrate, and a first via connecting the first upper coil pattern and the first lower coil pattern to each other through the support substrate, the second coil portion includes a second upper coil pattern disposed on the first surface of the support substrate to be spaced apart from the first upper coil pattern, a second lower coil pattern disposed on the second surface of the support substrate to be spaced apart from the first lower coil pattern, and a second via connecting the second upper coil pattern and the second lower coil pattern to each other through the support substrate, the first winding portion and the first extension portion are disposed in each of the first upper coil pattern and the first lower coil pattern, and the second winding portion and the second extension portion are disposed in each of the second upper coil pattern and the second lower coil pattern.

* * * * *